US006742860B2

(12) United States Patent
Harper

(10) Patent No.: US 6,742,860 B2
(45) Date of Patent: Jun. 1, 2004

(54) APPARATUS AND METHOD FOR CAPPING ONE OR MORE PRINTHEADS IN A PRINTING DEVICE

(75) Inventor: Kit L Harper, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/053,665

(22) Filed: Jan. 18, 2002

(65) Prior Publication Data

US 2003/0137553 A1 Jul. 24, 2003

(51) Int. Cl.[7] ..... B41J 2/165

(52) U.S. Cl. ..... 347/29

(58) Field of Search ..... 347/29, 30, 31, 347/32, 33

(56) References Cited

U.S. PATENT DOCUMENTS

| | | | | |
|---|---|---|---|---|
| 5,146,243 A | | 9/1992 | English et al. | 347/29 |
| 5,956,053 A | | 9/1999 | Michael | 347/29 |
| 6,074,037 A | * | 6/2000 | Nakahara et al. | 347/29 |
| 6,406,124 B1 | | 6/2002 | Davis et al. | 347/29 |

OTHER PUBLICATIONS

Hewlett–Packard patent application, Ser. No. 09/494,846; "Ganged Inkjet Printhead Capping System"; filed Jan. 31, 2000, patented, patent 6,406,124 Jun. 18, 2002.

* cited by examiner

*Primary Examiner*—Shih-wen Hsieh
(74) *Attorney, Agent, or Firm*—Erik A. Anderson

(57) ABSTRACT

An apparatus and method are disclosed herein for capping one or more printheads in a printing device. Further characteristics and features of the present invention are additionally disclosed herein, as are exemplary alternative embodiments. This abstract is not to be used in the interpretation of any of the claims.

30 Claims, 7 Drawing Sheets

APPARATUS AND METHOD FOR CAPPING ONE OR MORE PRINTHEADS IN A PRINTING DEVICE

BACKGROUND AND SUMMARY

The present invention relates to printing devices. More particularly, the present invention relates to an apparatus and method for capping one or more printheads in a printing device.

Printing devices, such as inkjet printers and laser printers, use printing composition (e.g., ink or toner) to print images (text, graphics, etc.) onto a print medium advanced through a printzone of the printing device by a print medium transport mechanism. Inkjet printers may use print cartridges, also known as "pens", which deposit printing composition, referred to generally herein as "ink", onto a print medium, such as paper, labels, forms, transparencies, or fabric, as the print medium is advanced through the printzone of the printing device. Each pen has a printhead that includes a plurality of nozzles. Each nozzle has an orifice through which printing composition is ejected. To print an image, the printhead is propelled back and forth across the print medium by, for example, a carriage while ejecting printing composition in a desired pattern as the printhead moves. The particular ink ejection mechanism within the printhead may take a variety of different forms known to those skilled in the art, such as thermal printhead technology. For thermal printheads, the ink may be a liquid, with dissolved colorants or pigments dispersed in a solvent.

During periods of nonuse, the printheads of the pens are capped to minimize evaporation of ink to the ambient through the nozzles. Capping also helps protect the printheads from damage. During capping, each of the caps pushes against the pens until a seal around the pen is achieved. The seal is made to discourage evaporation of printing composition from the nozzles to the ambient. When this seal is made, it may force air into the printhead which can cause one or more of the printhead nozzles to become deprimed. This seal also creates a volume of air in the cap. This volume fluctuates with pressure as temperature changes, or with altitude excursions and can also lead to depriming the nozzles. Depriming in-turn degrades output print quality of the printing device, potentially wastes print media, and can permanently damage the printheads.

A diffusion path may be used to help prevent depriming of the nozzles. The diffusion path creates an avenue for pressure equilibration with the ambient by allowing escape of air between the cap and the environment. The diffusion path also helps prevent depriming of the nozzles during capping by allowing compressed air to escape to the ambient. The diffusion path, however, can cause printing composition evaporation while a printhead is capped if too much printing composition is allowed to vent through the diffusion path to ambient over time. This leads to a loss of printing composition as well as possible clogging of one or more printhead nozzles, both of which are undesirable. Clogging can degrade output print quality, require replacement of a printhead if the nozzles cannot be unclogged, necessitate user intervention and potentially waste print media.

Alleviation of these above-described problems would be a welcome improvement. The present invention is directed to solving them with the goals of helping maintain optimal printing device output print quality, helping prevent printhead nozzle depriming, helping prevent loss of printing composition, helping prevent printhead nozzle clogging, helping prevent premature printhead replacement caused by damage, helping prevent waste of print media, and helping minimize necessary user intervention.

An embodiment of an apparatus in accordance with the present invention for use with a printhead includes a cap configured to define a first opening and to have a sealing member that abuts the printhead. The apparatus also includes a vent coupled to the first opening. The apparatus further includes a reservoir coupled to the cap via the vent and configured to be isolated from ambient as the sealing member abuts the printhead.

The above-described embodiment of an apparatus in accordance with the present invention may be modified and include at least the following characteristics, as described below. The reservoir may be configured to retain vapor from the printhead. The vent may be configured to have a length and a cross-sectional area. In such cases, the length of the vent is greater than the cross-sectional area of the vent. The reservoir may have a fixed volume.

The apparatus may further include a humectant in the reservoir. The apparatus may be used in a printing device.

An alternative embodiment of an apparatus in accordance with the present invention for capping a printhead includes a diffusion path and a first cavity having a first opening coupled to the diffusion path. The apparatus also includes a second cavity having a second opening coupled to the diffusion path and configured to communicate with the first cavity via the diffusion path. The diffusion path, first cavity, and second cavity are sealed from ambient during capping of the printhead.

The above-described alternative embodiment of an apparatus in accordance with the present invention may be modified and include at least the following characteristics, as described below. The second cavity may be configured to store vapor from the printhead. In such cases, the diffusion path may be sized to help minimize loss of vapor from the second cavity to ambient when the printhead is uncapped. The second cavity may have a fixed volume.

The apparatus may further include a humectant in the second cavity. The apparatus may be used in a printing device.

An embodiment of a method in accordance with the present invention for use in a printing device having a printhead includes capping the printhead and diffusing pressure variations caused by capping into a fixed volume. The method also includes sealing the printhead and fixed volume from ambient during capping.

The above-described embodiment of a method in accordance with the present invention may be modified and include at least the following characteristics, as described below. The printing device may include a plurality of printheads and the method may further include isolating each of the printheads from communication with one another. The method may additionally include retaining vapor from the printhead in the fixed volume. The method may further include limiting loss of vapor from the fixed volume.

An embodiment of an apparatus in accordance with the present invention for use in a service station includes a plurality of caps each including an opening and each configured to engage a printhead during nonuse. The apparatus also includes a plurality of separate chambers each of which is coupled to a different cap via a different opening, each of which is isolated to receive vapor from a single printhead, and each of which is sealed from ambient during cap and printhead engagement.

The above-described embodiment of an apparatus in accordance with the present invention may be modified and include at least the following characteristics, as described below. Each chamber may be configured to accommodate pressure variations occurring during cap and printhead engagement.

The apparatus may further include a plurality of conduits configured to couple the chambers to the caps. In such cases, the conduits may be configured to minimize loss of vapor during periods of printhead use. Also in such cases, the conduits may be the same length.

The apparatus may further include a humectant in each chamber. The apparatus may be used in a printing device.

Another alternative embodiment of an apparatus in accordance with the present invention for use in a printing device having a printhead with a plurality of nozzles includes structure for protecting the printhead during periods of nonuse. The apparatus also includes structure for diffusing pressure variations occurring during engagement between the structure for protecting and the printhead to help prevent nozzle deprimes. The apparatus further includes structure for isolating the printhead from ambient during engagement between the structure for protecting and the printhead.

The above-described alternative embodiment of an apparatus in accordance with the present invention may be modified and include at least the following characteristics, as described below. The apparatus may further include structure for collecting vapor released from the printhead during engagement between the structure for protecting and the printhead. Alternatively or additionally, the apparatus may further include structure for limiting loss of vapor from the structure for collecting during use of the printhead.

An alternative embodiment of a method in accordance with the present invention for use in a printing device having a printhead having a plurality of nozzles includes capping the printhead during periods of nonuse. The method additionally includes diffusing pressure variations that occur during capping of the printhead and isolating the printhead from ambient during capping of the printhead.

The above-described alternative embodiment of a method in accordance with the present invention may be modified and include at least the following characteristics, as described below. The printing device may include a plurality of printheads and the method may further include isolating each of the printheads from communication with one another.

The method may further include collecting vapor released from the printhead during capping of the printhead. Alternatively or additionally, the method may further include limiting loss of vapor collected from the printhead during capping.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Other objects, advantages, and novel features of the present invention will become apparent from the following detailed description when considered in conjunction with the accompanying drawings.

DETAILED DESCRIPTION OF THE DRAWINGS

Figure 1:
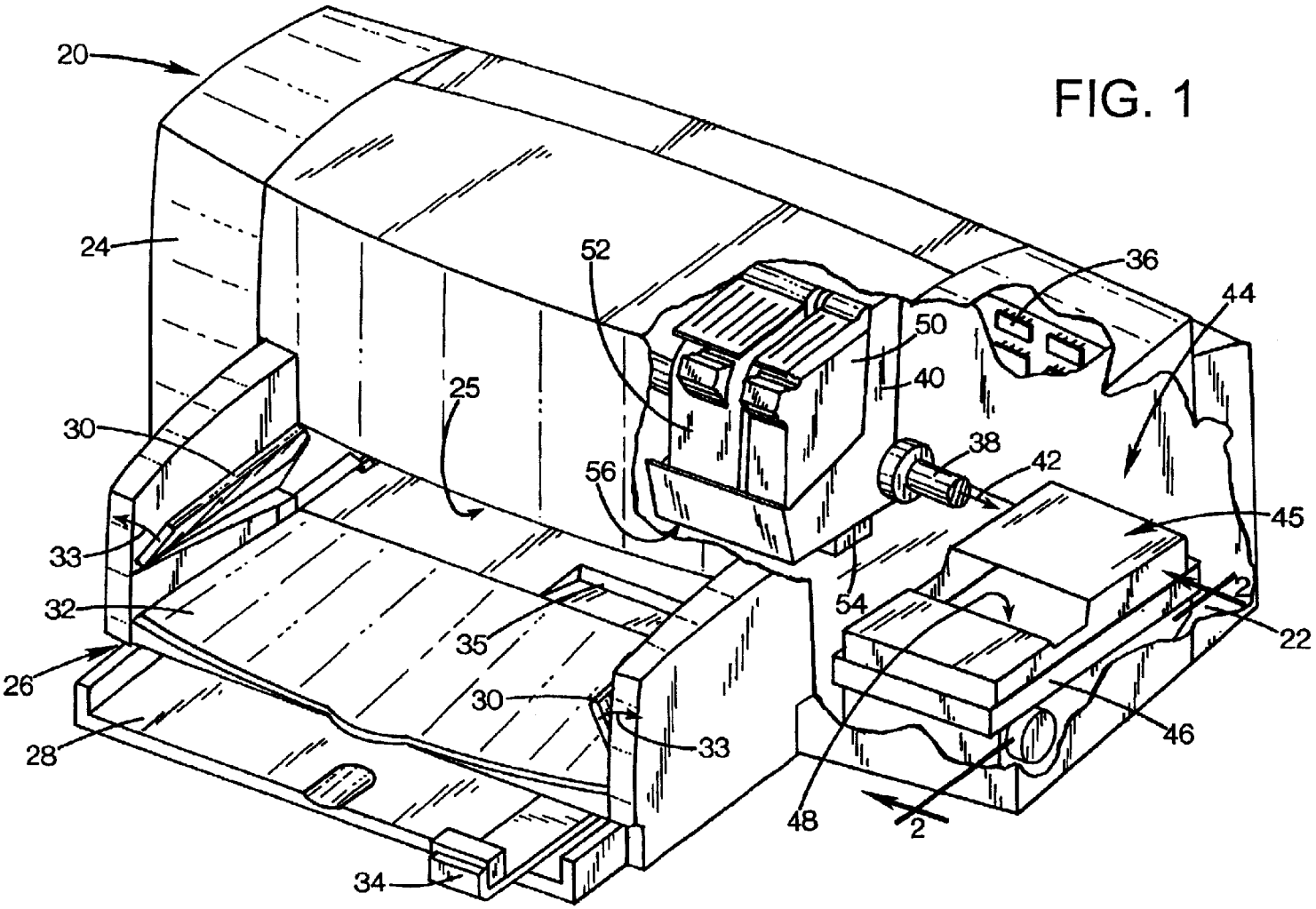
FIG. 1 is a perspective view of a printing device that includes an embodiment of the present invention.

FIG. 1 illustrates an embodiment of an inkjet printing device, here shown as an inkjet printer 20, constructed in accordance with the present invention, which may be used for printing business reports, correspondence, desktop publishing, and the like, in an industrial, office, home or other environment. A variety of printing devices are commercially available. For instance, some of the printing devices that may embody the present invention include plotters, portable printing units, copiers, cameras, video printers, facsimile machines, and multi-function devices to name a few. For convenience the concepts of the present invention are illustrated in the environment of an inkjet printer 20.

While it is apparent that the printer components may vary from model to model, a typical inkjet printer 20 includes a chassis 22 surrounded by a housing or casing enclosure 24, typically of a plastic material. Sheets of print media are fed through a print zone 25 by a print media handling system 26. The print media may be any type of suitable material, such as paper, card-stock, transparencies, mylar, fabric, photo paper, etc. Print media handling system 26 has a feed tray 28 for storing sheets of print media before printing. A series of conventional motor-driven drive rollers (not shown) may be used to move the print media from tray 28 into print zone 25 for printing. After printing, the sheet then lands on a pair of retractable output drying wing members 30, shown partially extended to receive a printed sheet. Wings 30 momentarily hold the newly printed sheet above any previously printed sheets still drying in output tray portion 32 before pivotally retracting to the sides, as generally indicated by curved arrows 33, to drop the newly printed sheet into output tray 32. Print media handling system 26 may include a series of adjustment mechanisms for accommodating different sizes of print media, including letter, legal, A-4, envelopes, photo media, etc., such as a sliding length adjustment lever 34, and an envelope feed slot 35. Although not shown, it is to be understood that printing device 20 may also include a sliding width adjustment lever for accommodating different widths of print media.

Printing device 20 also has a printer controller, illustrated schematically as a microprocessor 36, that receives instructions from a host device, typically a computer, such as a personal computer (not shown). Indeed, many of printer controller 36 functions may be performed by the host computer, by electronics on board printing device 20, or by interactions therebetween. As used herein, the term "printer controller 36" encompasses these functions, whether performed by the host computer, the printer, an intermediary device therebetween, or by a combined interaction of such elements. Printer controller 36 may also operate in response to user inputs provided through a key pad (not shown) located on the exterior of the casing 24. A monitor coupled to the computer host (both of which are not shown) may be used to display visual information to an operator, such as printing device 20 status or a particular program being run on the host computer. Personal computers, their input devices, such as a keyboard and/or a mouse device, and monitors are all well known to those skilled in the art.

A carriage guide rod 38 is supported by chassis 22 to slideably support a carriage 40 for travel back and forth across print zone 25 along a scanning axis 42 defined by the guide rod 38. A conventional carriage propulsion system (not shown) may be used to drive carriage 40 and may include a position feedback system, which communicates carriage position signals to controller 36. For instance, a carriage drive gear and DC motor assembly (both of which are not shown) may be coupled to drive an endless belt (also not shown) secured in a conventional manner to carriage 40, with the motor operating in response to control signals received from controller 36. To provide carriage positional feedback information to controller 36, an optical encoder reader (not shown) may be mounted to carriage 40 to read an encoder strip (also not shown) extending along the path of carriage travel.

Carriage 40 is also propelled along guide rod 38 into a servicing region, generally indicated by arrow 44, located within the interior of the casing 24. Servicing region 44 houses a service station 45, which may provide various conventional printhead servicing functions. For example, a service station frame 46 holds a group of printhead servicing appliances, described in greater detail below. In FIG. 1, a spittoon portion 48 of service station 45 is shown as being defined, at least in part, by service station frame 46.

In print zone 25, the print media sheet receives printing composition from one or more inkjet cartridges, such as black ink cartridge 50 and color ink cartridge 52. The cartridges 50 and 52 are also often called "pens" by those in the art. The illustrated color pen 52 is a tri-color pen, although in some embodiments, a set of discrete monochrome pens may be used. While color pen 52 may contain a pigment based ink, for the purposes of illustration, pen 52 is described as containing three dye based ink colors, such as cyan, yellow and magenta. Black ink pen 50 is illustrated herein as containing a pigment based ink. It is apparent that other types of inks may also be used in pens 50 and 52, such as thermoplastic, wax or paraffin based inks, as well as hybrid or composite inks having both dye and pigment characteristics.

The illustrated pens 50 and 52 each include reservoirs for storing a supply of ink. Pens 50 and 52 have printheads 54 and 56 respectively, each of which have an orifice plate with a plurality of nozzles formed therethrough in a manner well known to those skilled in the art. In the illustrations shown, printheads 54 and 56 are thermal inkjet printheads, although other types of printheads may be used with one or more embodiments of the present invention, such as piezoelectric printheads. Printheads 54 and 56 typically include a substrate layer having a plurality of resistors which are associated with the nozzles. Upon energizing a selected resistor, a bubble of gas is formed to eject a droplet of ink from the nozzle onto a print medium in print zone 25. The printhead resistors are selectively energized in response to enabling or firing command control signals. These signals may be delivered by a conventional multi-conductor strip (not shown) from controller 36 to carriage 40 and through conventional interconnects (also not shown) between carriage 40 and pens 50 and 52 to the printheads 54 and 56.

Figure 2:
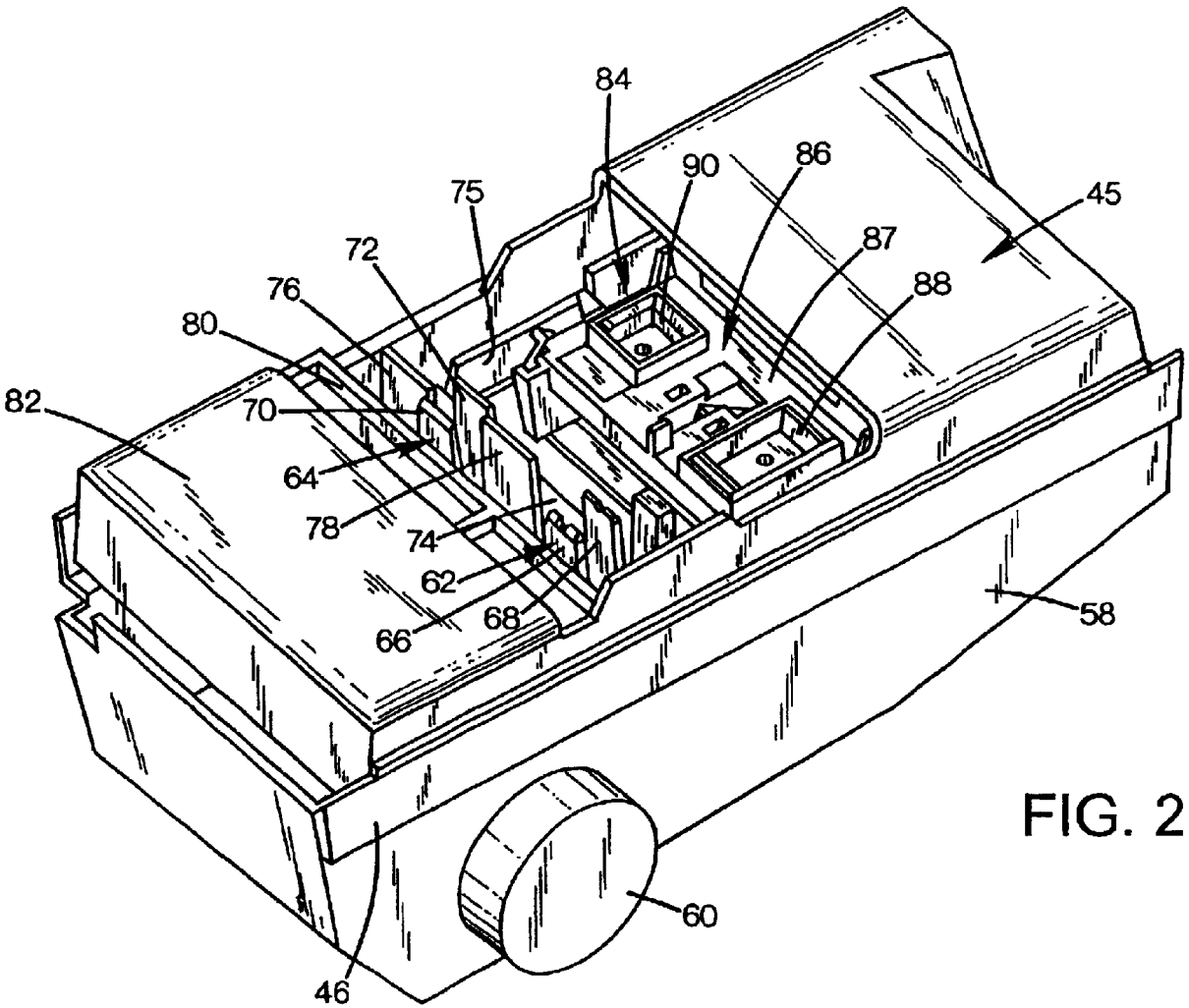
FIG. 2 is a perspective view of a service station taken along line 2—2 of FIG. 1 that includes an embodiment of the present invention.

A perspective view of service station 45 taken along line 2—2 of FIG. 1 that includes an embodiment of the present invention is shown in FIG. 2. As can be seen in FIG. 2, service station frame 46 includes a base member 58 which is attached to printer chassis 22. Base member 58 may be used to support a conventional service station drive motor, such as a stepper motor 60. Base member 58 also advantageously serves as the spittoon 48, as shown in FIG. 1.

As can also be seen in FIG. 2, service station 45 includes respective black and color printhead wiper assemblies 62 and 64 for orthogonally wiping the orifice plates of the respective black and color printheads 54 and 56. Black printhead wiper assembly 62 is designed to efficiently clean black printhead 54 by using two upright spaced-apart blade portions 66 and 68. Color printhead wiper assembly 64 also has two spaced-apart, upright blade portions 70 and 72 for wiping the color pen 52 which, in the embodiment shown has three dye based inks of cyan, magenta, and yellow. Wiper blades 66, 68, 70 and 72 may be joined to a wiper platform 74 in any conventional manner, such as by bonding with adhesives, sonic welding, or insert molding techniques, where the base of the wiper blade extends through holes formed within wiper platform 74. Wiper platform 74 in turn is attached to translating pallet 75 of service station 45. In the illustrated embodiment, wiper blades 66, 68, 70 and 72 are each made of a non-abrasive resilient material, such as an elastomer or plastic, a nitrile rubber or other rubber-like material, but preferably of an ethylene polypropylene diene monomer (EPDM), or other comparable material known to those skilled in the art.

As can be further seen in FIG. 2, color printhead wiper assembly 64 also includes wiper members 76 and 78, also know as "mud flaps" to those skilled in the art. Wiper members 76 and 78 may be constructed of the same elastomeric material as wipers 66, 68, 70 and 72 and attached in the same manner to wiper platform 74. Wiper members 76 and 78 are designed to clean any ink or debris from the edges of the orifice plate of color printhead 56 not already removed by color wiper blades 70 and 72.

To remove ink residue from the tips of the wipers 70 and 72 as well as mud flaps 76 and 78, service station 45 includes a wiper scraper bar 80, as shown in FIG. 2. Scraper bar 80 has an edge which is lower than the tips of wipers 70 and 72 and wiper members 76 and 78. Thus, when pallet 75 is moved in a direction toward scraper bar 80 by motor 60, wipers 70 and 72 and mud flaps 76 and 78 hit scraper bar 80, and advantageously flick any excess ink at the interior surfaces of the front portions of service station bonnet 82 and base member 58. During capping of printheads 54 and 56, as discussed more fully below, black printhead wiper assembly 62 and color printhead wiper assembly 64 are hidden under bonnet 82. Thus when printing device 20 is turned off, an operator cannot become soiled from inadvertently touching black printhead wiper assembly 62 or color printhead wiper assembly 64 because they are hidden from reach, as well as being protected from damage.

The other major component coupled to and supported by the pallet 75, is an exemplary embodiment of a capping assembly 84 constructed in accordance with the present invention. Capping assembly 84 includes a raiseable cap support platform or sled 86 on top 87 of which are mounted a black cap 88 and a color cap 90 for sealing respective black and color printheads 54 and 56 when pens 50 and 52 are not in use. Caps 88 and 90 may be joined to sled 86 by any conventional manner, such as by bonding with adhesives, sonic welding, or onsert molding techniques. In the illustrated embodiment, caps 88 and 90 are made of a non-abrasive resilient material, such as an elastomer or plastic, a nitrile rubber or other rubber-like material, but more preferably, caps 88 and 90 are made of an ethylene polypropylene diene monomer (EPDM), or other comparable material known to those skilled in the art.

Figure 3:
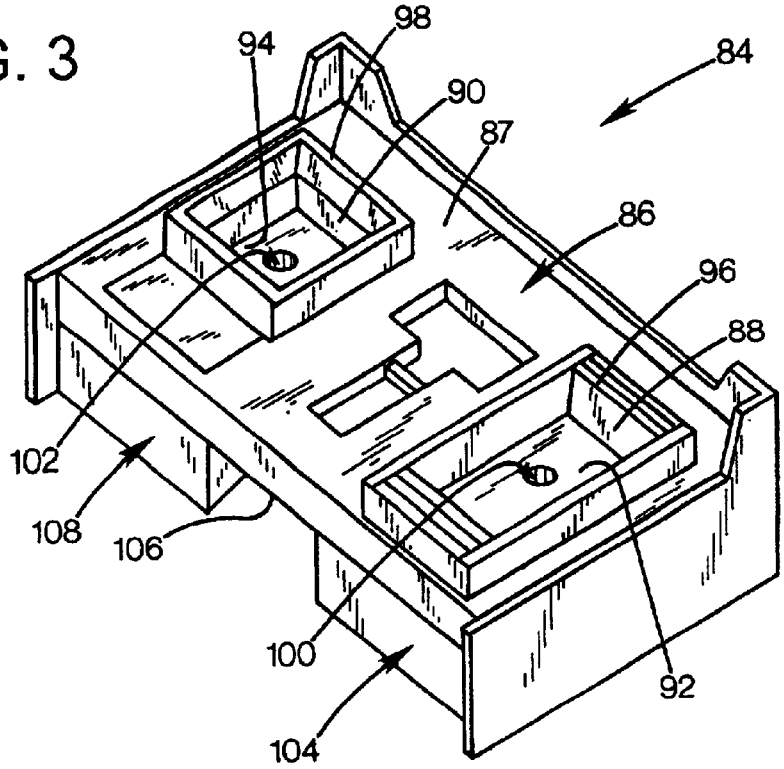
FIG. 3 is a top perspective view of an embodiment of a capping assembly in accordance with the present invention.

A top perspective view of capping assembly 84 is shown in FIG. 3. As can be seen in FIG. 3, caps 88 and 90 each define a respective cavity 92 and 94 and each include respective sealing members 96 and 98 that extend around the peripheries thereof and abut respective printheads 54 and 56 during capping. Caps 88 and 90 also include respective vents or diffusion paths 100 and 102 that are coupled to respective cavities 92 and 94. As can also be seen in FIG. 3, capping assembly 84 additionally includes a chamber or reservoir 104 on bottom 106 of platform 86 and a chamber or reservoir 108 on bottom 106 of platform 86. Chamber 104 is coupled to cap 88 via vent or diffusion path 100, as discussed more fully below, and is configured to be isolated from ambient as sealing member 96 abuts printhead 54. Chamber 108 is coupled to cap 90 via vent or diffusion path 102, as discussed more fully below, and is configured to be isolated from ambient as sealing member 98 abuts printhead 56.

Figure 4:
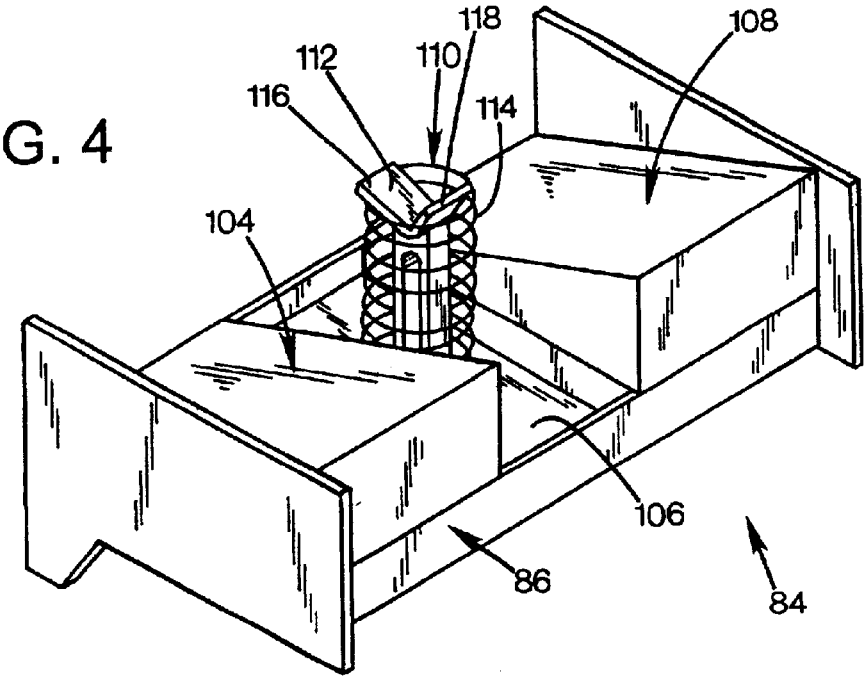
FIG. 4 is a bottom perspective view of the embodiment of the capping assembly shown in FIG. 3.

A bottom perspective view of capping assembly 84 is shown in FIG. 4. Reservoirs 104 and 108 of capping assembly 84 are visible, as is biasing member 110. Biasing member 110 includes a post 112 attached to bottom 106 of sled 86 and a spring 114 disposed around post 112 and captured by flanges 116 and 118. Biasing member 110 is configured to provide sufficient force so that sealing members 96 and 98 are compressed against printheads 54 and 56 during capping to protect printheads 54 and 56 and isolate them from the ambient during periods of nonuse.

Figure 5:
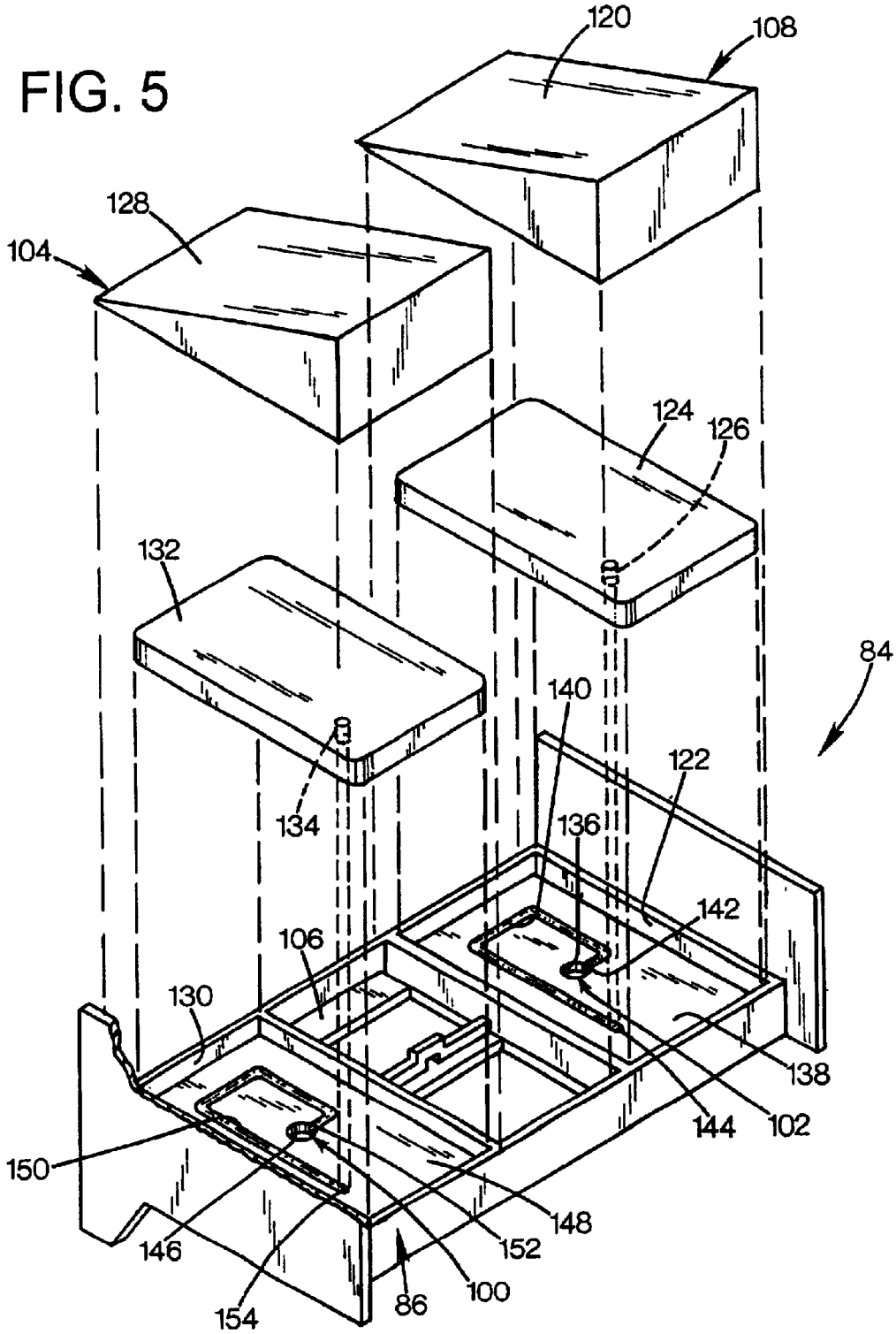
FIG. 5 is an exploded perspective view of the embodiment of the capping assembly shown in FIG. 4.

An exploded bottom perspective view of capping assembly 84 is shown in FIG. 5. Biasing member 110 is not shown in FIG. 5 and has been removed for clarity purposes only. As can be seen in FIG. 5, reservoir or chamber 104 includes a cover 128 that is normally secured in recess 130 of platform 86. Reservoir 104 also includes a sealing member 132 disposed in recess 130 of platform 86 between floor 148 and cover 128. Sealing member 132 is formed of an elastomeric material and includes a opening 134 formed therethrough. Opening 134 is coupled to cover 128. Reservoir or chamber 108 includes a cover 120 that is normally secured in recess 122 of platform 86. Reservoir 108 also includes a sealing member 124 disposed in recess 122 of platform 86 between floor 138 and cover 120. Sealing member 124 is formed of an elastomeric material and includes a opening 126 formed therethrough. Opening 126 is coupled to cover 120.

As can also be seen in FIG. 5, vent or diffusion path 100 includes an opening 146 formed through floor 148 of recess 130 and a passageway 150 formed in floor 148 of recess 130. First end 152 of passageway 150 is coupled to opening 146 and second end 154 of passageway 150 is coupled to opening 134 of sealing member 132. Vent or diffusion path 102 includes an opening 136 formed through floor 138 of recess 122 and a passageway 140 formed in floor 138 of recess 122. First end 142 of passageway 140 is coupled to opening 136 and second end 144 of passageway 140 is coupled to opening 126 of sealing member 124.

Figure 6:
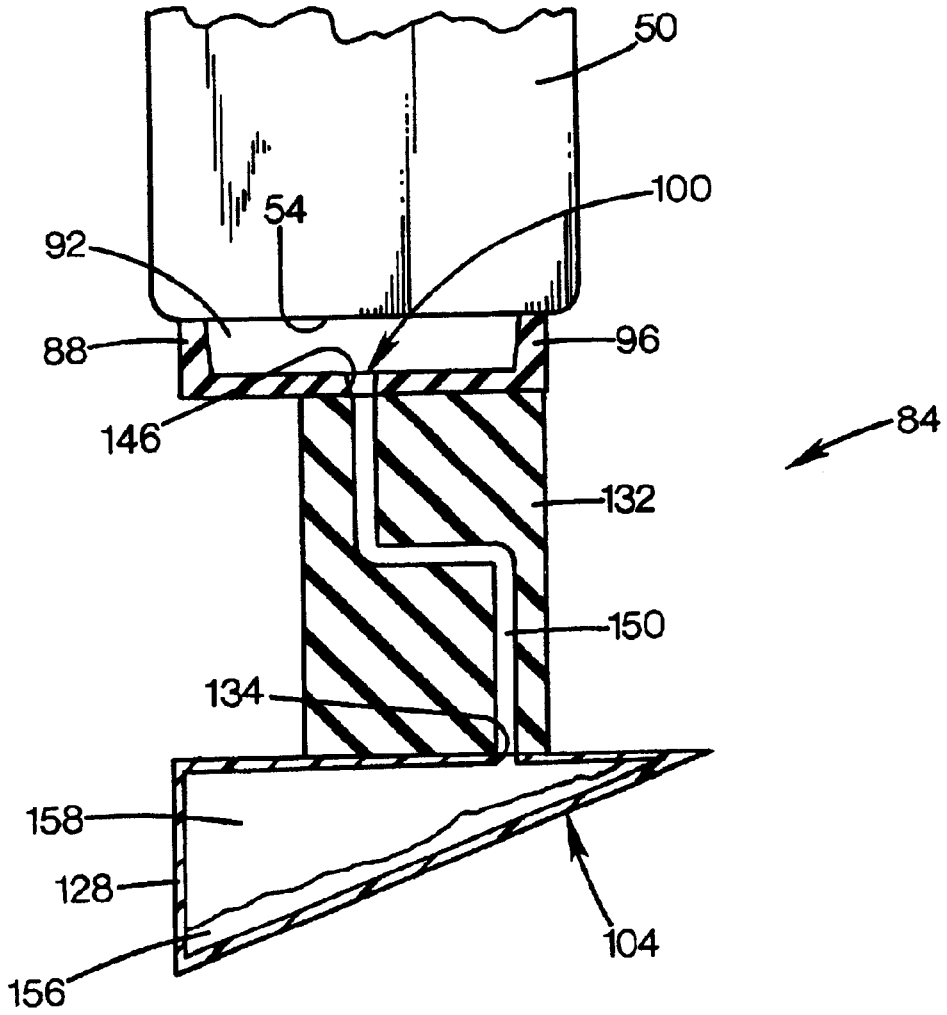
FIG. 6 is a diagrammatic view of an embodiment of a capping assembly, in accordance with the present invention, capping a printhead of an inkjet cartridge.

A diagrammatic view of capping assembly 84 capping or engaging printhead 54 of black ink cartridge 50 during a period of nonuse is shown in FIG. 6. Although not shown in FIG. 6, it is to understood that capping assembly 84 is also capping or engaging printhead 56 of color ink cartridge 52. The discussion below in connection with FIG. 6 is equally applicable to the elements of capping assembly 84 that are capping printhead 56 of color ink cartridge. It is also to be understood that in FIG. 6, for illustrative purposes, not all of the components of capping assembly 84 are drawn to scale with respect to FIGS. 2–5. For example, the size, shape and orientation of sealing member 132 and passageway 150 of diffusion path 100 have been changed.

As can be seen in FIG. 6, sealing member 96 of black cap 88 abuts printhead 54 to protect printhead 54 during periods of nonuse. As can also be seen in FIG. 6, cap 88, sealing member 132, opening 134, opening 146, passageway 150, and reservoir 104 are configured so that cavity 92, diffusion path 100, and cavity 158 are sealed or isolated from ambient during capping of printhead 54. This isolation from ambient helps prevent loss of printing composition through the nozzles (not shown) of printhead 54. This isolation from ambient also helps prevent loss of vapor stored in cavity 158 of reservoir 104. This vapor provides a humid environment for the nozzles of printhead 54 to help keep them from clogging with printing composition. Such clogging, if not cleared, degrades output print quality of printing device 20 and can damage printhead 54, shortening its operating life.

As can be further seen in FIG. 6, capping assembly 84 also includes a humectant 156 disposed in cavity 158 of cover 128. Cavity 158 is configured to collect vapor released from printhead 54 during capping thereof. In the embodiment of capping assembly 84 shown, cover 128 is configured of a rigid material so that the volume of cavity 158 remains fixed.

Humectant 156 may be formed from any substance that collects and retains moisture. Retention of moisture helps maintain a humid environment within cavity 92, diffusion path 100, and cavity 158 during capping which, in turn, helps keep the nozzles of printhead 54 from clogging during capping, as discussed above. Retention of moisture by humectant 156 also helps minimize loss of vapor from capping assembly 84 when printhead 54 is uncapped. Vent or diffusion path 100 is also configured or sized to help minimize loss of vapor from cavity 158 when printhead 54 is uncapped by acting as a "bottleneck" to the escape of vapor within cavity 158 to the ambient atmosphere. As can be seen in both FIGS. 5 and 6, this can be accomplished by configuring the length of vent or diffusion path 100 to be greater than the cross-sectional area of vent or diffusion path 100.

Diffusion path 100 and cavity 158 act together, in accordance with the present invention, to help prevent depriming of the nozzles of printhead 54 as printhead 54 is capped. During capping of printhead 54, air in cavity 92 is compressed and will normally be forced into the nozzles of printhead 54, unless it has an alternative path. Air forced through these nozzles will likely cause one or more printhead 54 nozzles to become deprimed which is undesirable. Depriming degrades output print quality of printing device 20, can potentially waste printing composition, and possible permanently damage printhead 54. In accordance with the present invention, cavity 158 and diffusion path 100 are configured to provide an alternative path for this compressed air that is sufficiently sized to relieve the build-up of pressure around the nozzles of printhead 54 which can cause such deprimes.

Capping assembly 84, in accordance with the present invention, is also configured to help prevent depriming of the nozzles of printhead 54 during ambient pressure changes caused by temperature changes and altitude excursions. Cavity 158 is sufficiently sized, in accordance with the present invention, to have a sufficient volume to absorb such pressure changes so that a build-up of pressure within cavity 92 does not force printing composition from the nozzles of printhead 54, causing deprimes.

Figure 7:
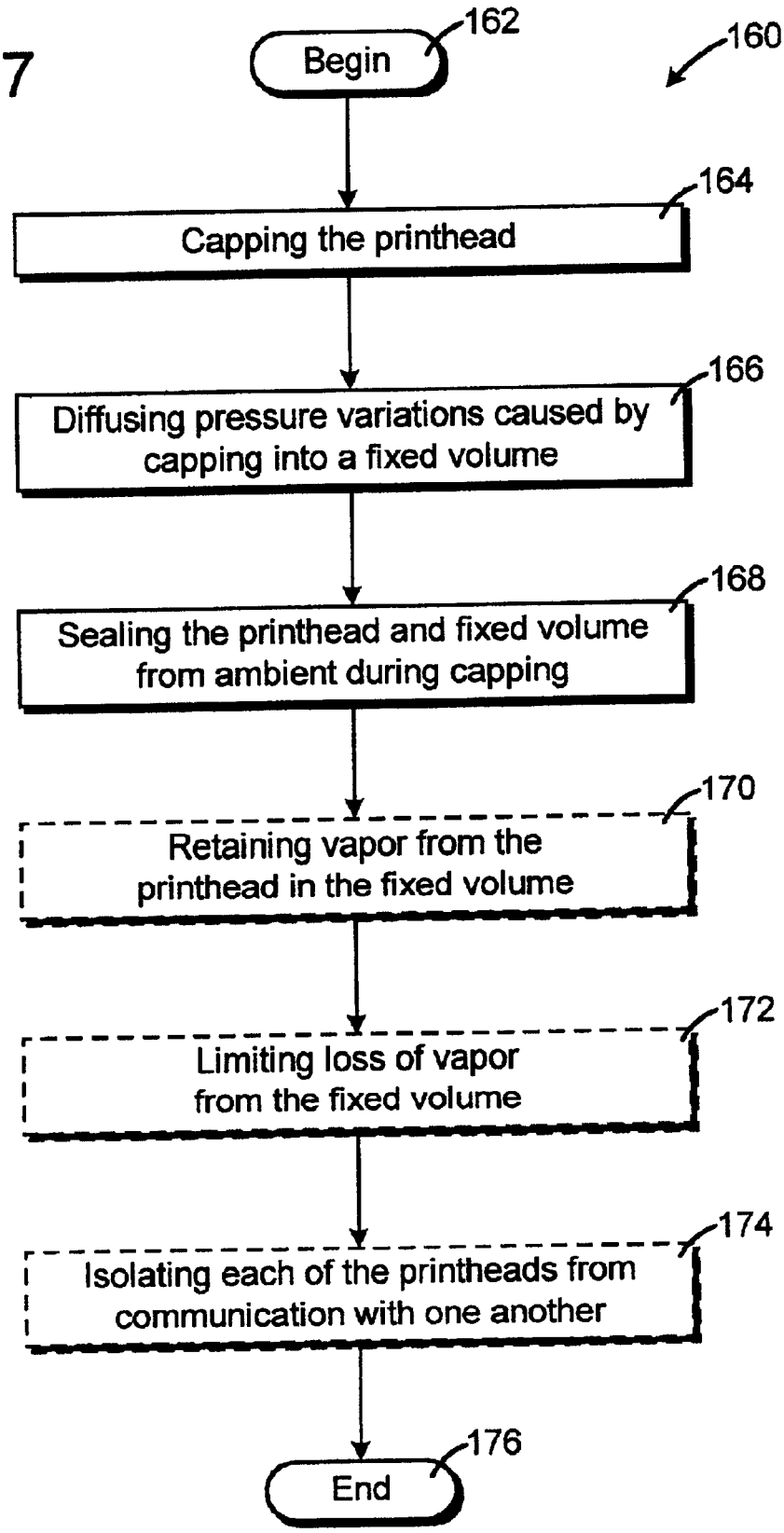
FIG. 7 is a diagram of an embodiment of a method in accordance with the present invention.

A diagram of an embodiment of a method 160, in accordance with the present invention, for use in printing device 20 having at least one printhead is shown in FIG. 7. As can be seen in FIG. 7, method 160 begins 162 by capping the printhead 164. Next, method 160 diffuses pressure variations caused by capping into a fixed volume 166 and seals the printhead and fixed volume from ambient during capping 168. Method 160 may additionally retain vapor from the printhead in the fixed volume 170. Alternatively or additionally, method 160 may limit loss of vapor from the fixed volume 172. In cases where printing device 20 includes a plurality of printheads, method 160 may further include isolating each of the printheads from communication with one another 174. Method 160 then ends, as generally indicated by block 176.

Figure 8:
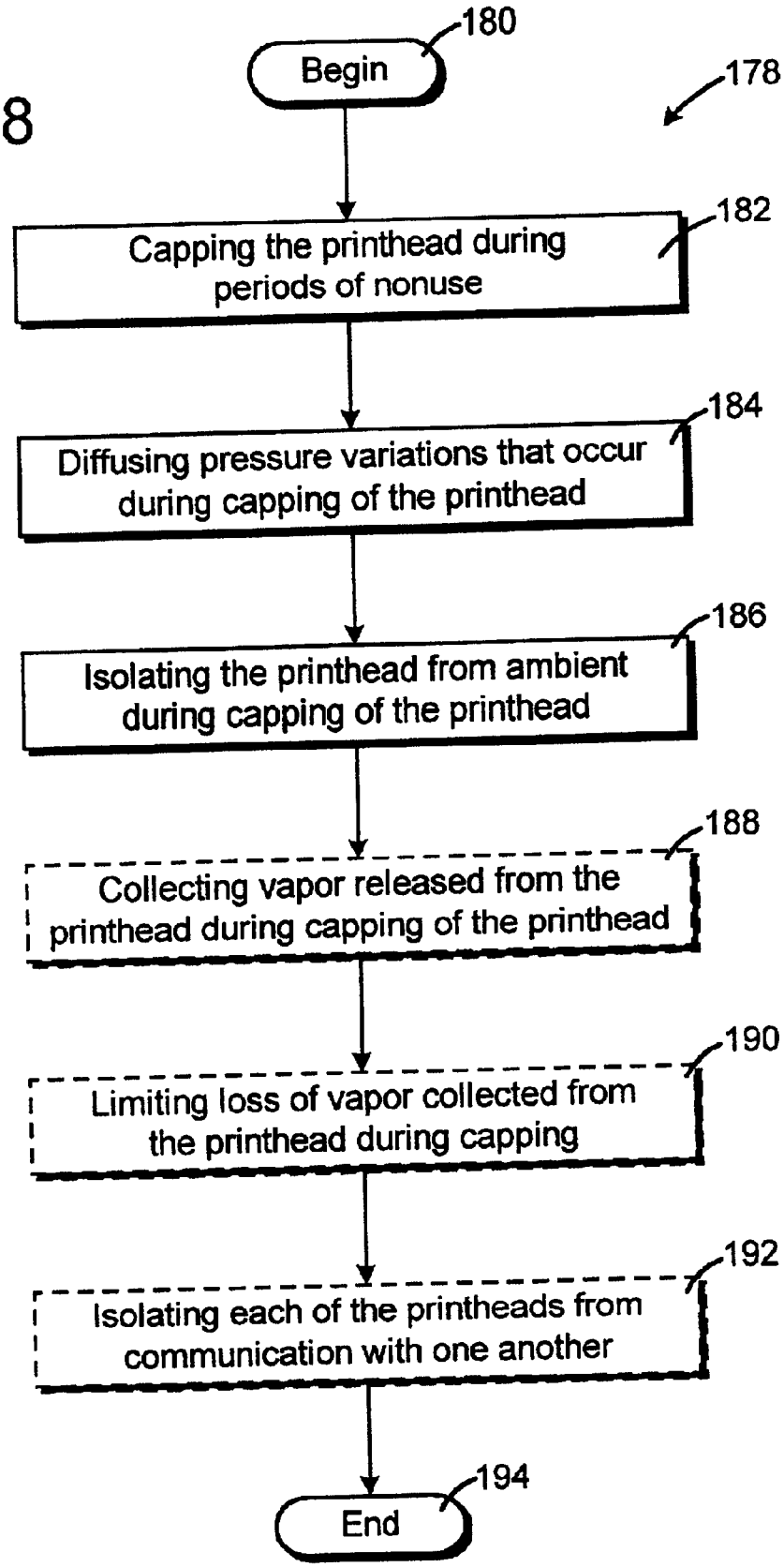
FIG. 8 is a diagram of an alternative embodiment of a method in accordance with the present invention.

A diagram of an alternative embodiment of a method 178, in accordance with the present invention, for use in printing device 20 having at least one printhead that includes a plurality of nozzles is shown in FIG. 8. As can be seen in FIG. 8, method 178 begins 180 by capping the printhead during periods of nonuse 182. Next, method 178 diffuses pressure variations that occur during capping of the printhead 184 and isolates the printhead from ambient during capping of the printhead 186. Method 178 may additionally collect vapor released from the printhead during capping of the printhead 188. In such cases, method 178 may also limit loss of vapor collected from the printhead during capping 190. In cases where printing device 20 includes a plurality of printheads, method 178 may isolate each of the printheads from communication with one another 192. Method 178 then ends, as generally indicated by block 194.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiments disclosed. Modifications and variations may well be apparent to those skilled in the art. For example, in one or more alternative embodiments of the present invention, cover 120 may be constructed from a flexible material so that the volume of cavity 158 can change with pressure variations. Similarly, any method elements described may be interchangeable with other method elements in order to achieve the same result. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . . . "

What is claimed is:

1. An apparatus for use with a printhead, comprising:

a cap configured to define a first opening and to have a sealing member that abuts the printhead;

a vent coupled to the first opening; and a reservoir coupled to the cap via the vent and configured to be isolated from ambient as the sealing member abuts the printhead.

2. The apparatus of claim 1, wherein the reservoir is configured to retain vapor from the printhead.

3. The apparatus of claim 2, wherein the vent is configured to have a length and a cross-sectional area, and further wherein the length of the vent is greater than the cross-sectional area of the vent.

4. The apparatus of claim 1, further comprising a humectant in the reservoir.

5. The apparatus of claim 1, wherein the reservoir has a fixed volume.

6. The apparatus of claim 1, in a printing device.

7. An apparatus for capping a printhead, comprising:

a diffusion path;

a first cavity having a first opening coupled to the diffusion path; and a second cavity having a second opening coupled to the diffusion path and configured to communicate with the first cavity via the diffusion path;

wherein the diffusion path, first cavity, and second cavity are sealed from ambient during capping of the printhead.

8. The apparatus of claim 7, wherein the second cavity is configured to store vapor from the printhead.

9. The apparatus of claim 8, wherein the diffusion path is abed to help minimize loss of vapor from the second cavity when the printhead is uncapped.

10. The apparatus of claim 7, further comprising a humectant in the second cavity.

11. The apparatus of claim 7, wherein the second cavity has a fixed volume.

12. The apparatus of claim 7, in a printing device.

13. A method for use in a printing device having a printhead, comprising:

capping the printhead;

diffusing pressure variations caused by capping into a fixed volume; and scaling the printhead and fixed volume from ambient during capping.

14. The method of claim 13, wherein the printing device includes a plurality of printheads and further comprising isolating each of the printheads from communication with one another.

15. The method of claim 13, further comprising retaining vapor from the printhead in the fixed volume.

16. The method of claim 15, further comprising limiting loss of vapor from the fixed volume.

17. An apparatus for use in a service station, comprising:

a plurality of caps each including an opening and each configured to engage a printhead during nonuse; and a plurality of separate chambers each of which is coupled to a different cap via a different opening, each of which is isolated to receive vapor from a single printhead, and each of which is sealed from ambient during cap and printhead engagement.

18. The apparatus of claim 17, wherein each chamber is configured to accommodate pressure variations occurring during cap and printhead engagement.

19. The apparatus of claim 17, further comprising a plurality of conduits configured to couple the chambers to the cap.

20. The apparatus of claim 19, wherein the conduits are configured to minimize loss of vapor during periods of printhead use.

21. The apparatus of claim 19, wherein the conduits are the same length.

22. The apparatus of claim 17, further comprising a humectant in each chamber.

23. The apparatus of claim 17, in a printing device.

24. An apparatus for use in a printing device having a printhead that includes a plurality of nozzles, comprising:

means for protecting the printhead during periods of nonuse;

means for diffusing pressure variations occurring during engagement between the means for protecting and the printhead to help prevent nozzle deprimes; and means for isolating the printhead from ambient during engagement between the means for protecting and the printhead.

25. The apparatus of claim 24, further comprising means for collecting vapor released from the printhead during engagement between the means for protecting and the printhead.

26. The apparatus of claim 24, further comprising means for limiting loss of vapor from the means for collecting during use of the printhead.

27. A method for use in a printing device having a printhead that includes a plurality of nozzles, comprising:

capping the printhead with a cap during periods of non-use;

connecting the cap to a fixed volume;

diffusing between the cap and fixed volume pressure variations that occur during capping of the printhead; and isolating the printhead, cap, and the fixed volume from ambient during capping of the printhead.

28. The method of claim 27, wherein the printing device includes a plurality of printheads and further comprising isolating each of the printheads from communication with one another.

29. The method of claim 27, further comprising collecting with a humectant vapor released from the printhead during capping of the printhead.

30. The method of claim 29, further comprising limiting loss of vapor collected from the printhead during capping.

* * * * *